US007938504B2

(12) United States Patent
Lee et al.

(10) Patent No.: US 7,938,504 B2
(45) Date of Patent: May 10, 2011

(54) PRINTING DEVICE

(75) Inventors: Shirley Lee, Poway, CA (US); Diane Armstrong, Carlsbad, CA (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 866 days.

(21) Appl. No.: 11/729,290

(22) Filed: Mar. 27, 2007

(65) Prior Publication Data

US 2008/0238992 A1 Oct. 2, 2008

(51) Int. Cl.
*B41J 2/165* (2006.01)

(52) U.S. Cl. ..... 347/36; 347/30; 347/31; 347/32; 347/33; 347/34; 347/35

(58) Field of Classification Search ..... 347/30–36
See application file for complete search history.

(56) References Cited

U.S. PATENT DOCUMENTS

| | | | | |
|---|---|---|---|---|
| 5,157,421 | A * | 10/1992 | Kitahara | 347/86 |
| 5,500,659 | A * | 3/1996 | Curran et al. | 347/28 |
| 5,713,991 | A * | 2/1998 | Kimura | 106/31.39 |
| 6,629,750 | B2 * | 10/2003 | Ciordia | 347/36 |
| 6,637,859 | B2 * | 10/2003 | Williamson et al. | 347/36 |
| 6,670,521 | B2 | 12/2003 | Noda et al. | |
| 6,840,603 | B2 * | 1/2005 | Barinaga et al. | 347/85 |
| 7,111,923 | B2 * | 9/2006 | Kulpa | 347/36 |
| 7,216,954 | B2 * | 5/2007 | Kulpa et al. | 347/35 |
| 7,354,135 | B2 * | 4/2008 | Kimura | 347/36 |
| 7,461,930 | B2 * | 12/2008 | Rosa | 347/86 |
| 2001/0014388 | A1 | 8/2001 | Bastioli et al. | |
| 2003/0112287 | A1 * | 6/2003 | Long | 347/35 |
| 2003/0220039 | A1 | 11/2003 | Chen et al. | |

FOREIGN PATENT DOCUMENTS

| | | | |
|---|---|---|---|
| JP | 07323561 A | * | 12/1995 |
| WO | WO 93/00116 | | 1/1993 |
| WO | WO 99/12976 | | 3/1999 |

* cited by examiner

*Primary Examiner* — Ryan Lepisto
*Assistant Examiner* — Guy G Anderson

(57) ABSTRACT

Embodiments of a biodegradable absorbent material in a permeable membrane are disclosed.

19 Claims, 1 Drawing Sheet

PRINTING DEVICE

BACKGROUND

Printing devices may include an ink receiving reservoir for receiving ink expelled from a printhead during servicing. The ink receiving reservoir may include an open cell foam to receive and retain the expelled ink. However, such open cell foam materials may allow ink to seep therefrom, which may cause undesirable ink leakage within the printing device. It may be desirable to provide an ink receiving reservoir that reduces leakage of ink therefrom.

DETAILED DESCRIPTION OF THE DRAWINGS

Figure 1:
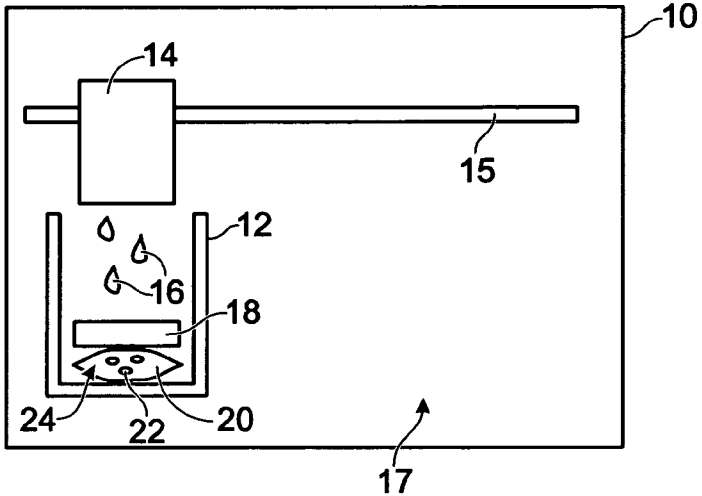
FIG. 1 is a schematic view of one example embodiment of a printing device including an ink receiving reservoir.

FIG. 1 is a schematic view of one example embodiment of a printing device 10 including an ink receiving reservoir 12 positioned below a printhead 14. During routine servicing of printhead 14, ink 16 may be expelled from the printhead 14 to clear the nozzle orifices (not shown). This servicing routine may be conducted many times throughout the life of printing device 10 such that a large volume of ink 16 may be retained within ink receiving reservoir 12. After servicing of printhead 14 the printhead may be moved along a drive shaft 15 to a print zone 17.

Reservoir 12 may include an open cell foam 18 positioned for initially receiving ink 16 expelled from printhead 14. The ink 16 may then seep downwardly through open cell foam 18 and onto a permeable membrane 20 positioned below foam 18. Permeable membrane 20 may include an absorbent material 22 positioned within a sealed interior cavity 24 of permeable membrane 20. Prior to absorbance of ink 16 into absorbent material 22, material 22 may be in a dry, granular or powder like form. After absorbance of fluid, such as ink 16, into absorbent material 22, absorbent material 22 may change form to a gel (see FIG. 4) like material that may be retained within permeable membrane 20. Accordingly, permeable membrane 20 may be permeable to fluid, such as ink 16, but may be impermeable to absorbent material 22 in both dry, powder form and wet, gel form.

Figure 2:
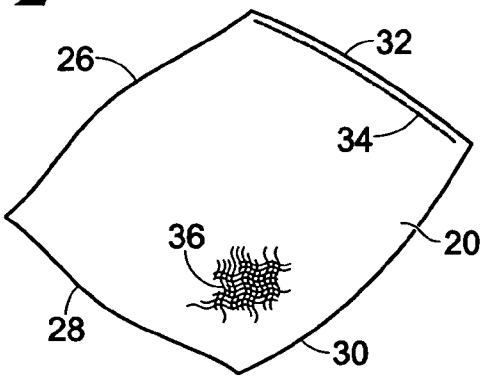
FIG. 2 is an isometric view of one example embodiment of a permeable membrane including an absorbent material therein.

FIG. 2 is an isometric view of one example embodiment of a permeable membrane 20 including absorbent material 22 (see FIG. 1) therein. Membrane 20 may be initially sealed around three sides 26, 28 and 30. Absorbent material 22 (see FIG. 1) may then be placed therein and a fourth side 32 may then be sealed by stitching 34, folding (not shown), adhesive (not shown), a drawstring (not shown), or the like. Permeable membrane 20 may be manufactured of a fabric and/or cloth material, such as cotton for example, or may be manufactured of a cloth like paper material, having a woven texture 36 (only a small section shown for ease of illustration), for example, that allows fluid to penetrate therethrough while inhibiting absorbent material 22 from exiting sealed cavity 24 (see FIG. 1).

Figure 3:
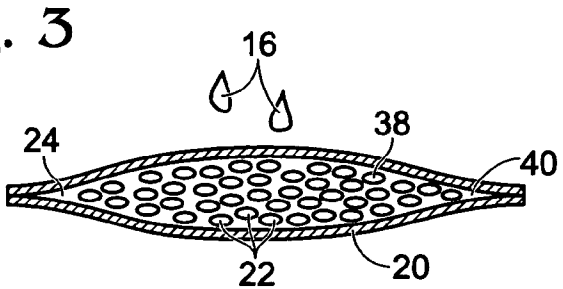
FIG. 3 is a cross sectional side view of one example embodiment of the membrane and absorbent material of FIG. 2 in a dry condition.

FIG. 3 is a cross sectional side view of one example embodiment of membrane 20 and absorbent material 22 of FIG. 2 in a dry, granular or powdery condition. In this dry condition, absorbent material 22 may define a plurality of granules 38 that define a small volume 40 within sealed interior cavity 24 of membrane 20. Granules 38 may be manufactured in a size suited for a particular application such as a 30 to 100 size mesh granule, a 100 to 200 size mesh granule, or a greater than 200 size mesh granule, for example. The size of woven texture 36 (see FIG. 2) may be chosen so as to retain granules 38 within interior cavity 24 of membrane 20.

Absorbent material 22 may be manufactured of a cross-linked starch polymer, or a grafted starch polymer, and may be biodegradable. Absorbent material 22 may be super absorbent, meaning that material 22 may be able to absorb at least ten times its weight in fluid, such as ink 16 (see FIG. 1), and in the embodiment shown, may be able to absorb at least twenty times its weight in fluid. In one example embodiment, material 22 may be an organically based product manufactured from corn starch, may be non-toxic and pH neutral, may absorb up to 400 times its weight in fluid, may allow for increased porosity and improved passing of water and oxygen throughout reservoir 12, and may hydrate and rehydrate over its useful life of at least one year. Rehydration of material 22 may be described as additional fluid being absorbed therein after water evaporation from material 22. After its useful life, membrane 20, with material 22 held therein, may be removed from printing device 10 and a new membrane 20, with fresh absorbent material 22 contained therein, placed within reservoir 12 (see FIG. 1).

Figure 4:
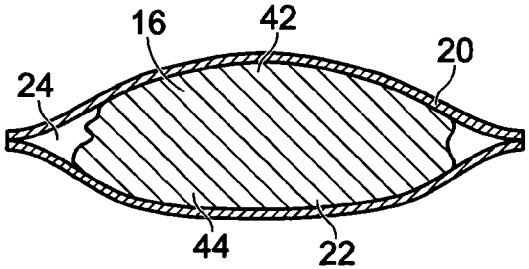
FIG. 4 is a cross sectional side view of one example embodiment of the membrane and absorbent material of FIG. 2 in a wet condition.

FIG. 4 is a cross sectional side view of one example embodiment of membrane 20 and absorbent material 22 of FIG. 2 in a wet condition. In this wet condition, granules 38 (see FIG. 3) of absorbent material 22 have absorbed ink 16 such that absorbent material 22 has gelled within permeable membrane 20 to form a gel 42. In one example embodiment, 0.08 grams of absorbent material granules 38 (see FIG. 3) absorbed 11.5 grams of ink to form a non-flowing gel 42, that was retained within permeable membrane 20. Absorbent material 22 may absorb any type of fluid, and in particular, may be useful for absorbing pigmented inks 16 (see FIG. 1) that may undergo heavy or frequent servicing and expelling routines from printhead 14 within printing device 10. Material 22 may also absorb water, solvent, and/or other ink components. After material 22 has absorbed fluid, such as ink 16, gel 42 may define a large volume 44 that is larger than the small volume 40 (see FIG. 3) of granules 38 of material 22 in its dry, powdery form. Permeable membrane 20 may be initially sized such that upon the increase in volume of material 22 as it absorbs moisture, the material 22 will still be retained within membrane 20.

Due to the fluid retaining capabilities of gelled absorbent material 22, reservoir 12 of printing device 10 may retain more fluid therein, without an increase in the size of the reservoir, compared to a reservoir containing only an open cell foam material 18. Accordingly, a printing device 10 having a sealed, permeable membrane 20 containing absorbent material 22 therein, may undergo less frequent servicing by a technician than a prior art printing device that retains ink therein with only the use of an open cell foam which may be susceptible to seeping of the ink therefrom. Moreover, containing absorbent material 22 within a permeable membrane 20 may allow faster, cleaner and more cost effective removal of used ink from a printing device 10 such that the printing device may be more quickly placed back on line. The biodegradable, non-toxic nature of absorbent material 22 and membrane 20 may also facilitate the quick, clean and cost effective disposal of used ink 16 without the payment of hazardous disposal fees.

Other variations and modifications of the concepts described herein may be utilized and fall within the scope of the claims below.

We claim:

1. A printing device, comprising:

an ink receiving structure for receiving ink expelled from a printhead; and a biodegradable, cross-linked polymer absorbent material enclosed in a permeable membrane that is permeable to the ink, said permeable membrane positioned within said ink receiving structure.

2. The device of claim 1 wherein said absorbent material comprises a grafted starch polymer based material.

3. The device of claim 1 wherein said absorbent material includes corn starch.

4. The device of claim 1 wherein said absorbent material is adapted to absorb at least 20 times its weight in the ink.

5. The device of claim 1 wherein said absorbent material is in powder form prior to absorbance of the ink.

6. The device of claim 1 wherein said absorbent material forms a gel after absorbance of the ink.

7. The device of claim 1 wherein said permeable membrane comprises an ink permeable cloth.

8. The device of claim 1 wherein said permeable membrane completely seals said absorbent material therein.

9. A method of absorbing ink in a printing device, comprising:

providing a reservoir for receiving ink expelled from a printhead of a printing device;

providing a starch based absorbent material in said reservoir, the starch based absorbent material selected from a cross-linked starch polymer; and expelling ink from a printhead into said reservoir whereupon said ink is absorbed into said absorbent material to form a gel within said reservoir.

10. The method of claim 9 wherein said absorbent material is held within a permeable membrane positioned within said reservoir, and wherein said expelled ink permeates through said permeable membrane prior to absorbance of said ink by said absorbent material.

11. The method of claim 9 wherein said absorbent material is biodegradable.

12. The method of claim 9 further comprising providing an open cell foam in said reservoir, said open cell foam being positioned between said printhead and said absorbent material, and wherein said step of expelling ink into said reservoir comprises expelling ink onto said open cell foam whereupon said ink is absorbed from said open cell foam into said absorbent material to form a gel within said reservoir.

13. A printhead servicing structure in a printing device, comprising:

an ink container for receiving ink expelled from a printhead during servicing of the printhead; and a biodegradable polymer absorbent material enclosed in a permeable membrane that is permeable to the ink, said permeable membrane positioned within said ink container.

14. The structure of claim 13 wherein said absorbent material is pH neutral.

15. The structure of claim 13 wherein said absorbent material absorbs the ink, the ink being chosen from one of a pigmented ink and a dye-based ink.

16. An absorbent structure for absorbing ink, comprising:

an ink permeable membrane that defines a sealed interior cavity; and a starch based absorbent material enclosed in said sealed interior cavity, the starch based absorbent material being selected from a cross-linked starch polymer.

17. The structure of claim 16 wherein said membrane defines a sealed cloth bag.

18. The structure of claim 16 wherein said sealed interior cavity defines a volume sufficient to enclose said absorbent material in a swelled, fluid absorbed condition.

19. The structure of claim 16 wherein said membrane inhibits said absorbent material from exiting said sealed interior cavity.

* * * * *